US009677829B2

(12) United States Patent
Harada et al.

(10) Patent No.: US 9,677,829 B2
(45) Date of Patent: Jun. 13, 2017

(54) TOTAL HEAT EXCHANGING ELEMENT PAPER

(75) Inventors: Junji Harada, Tokyo (JP); Masayuki Tsubaki, Tokyo (JP); Takehiko Ajima, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 0 days.

(21) Appl. No.: 10/333,744

(22) PCT Filed: May 30, 2002

(86) PCT No.: PCT/JP02/05283

§ 371 (c)(1),
(2), (4) Date: Jan. 29, 2003

(87) PCT Pub. No.: WO02/099193

PCT Pub. Date: Dec. 12, 2002

(65) Prior Publication Data

US 2003/0226656 A1 Dec. 11, 2003

(30) Foreign Application Priority Data

Jun. 1, 2001 (JP) ..... 2001-166302
Sep. 10, 2001 (JP) ..... 2001-273474
Nov. 30, 2001 (JP) ..... 2001-367457

(51) Int. Cl.

| | |
|---|---|
| ***F28F 1/00*** | (2006.01) |
| ***F28F 21/00*** | (2006.01) |
| ***D21H 11/18*** | (2006.01) |
| ***D21H 27/00*** | (2006.01) |
| ***F24F 3/14*** | (2006.01) |
| *D21H 17/10* | (2006.01) |
| *D21H 27/06* | (2006.01) |

(52) U.S. Cl.

CPC ..... *F28F 21/00* (2013.01); *D21H 11/18* (2013.01); *D21H 27/00* (2013.01); *F24F 3/1423* (2013.01); *D21H 17/10* (2013.01); *D21H 27/06* (2013.01); *F24F 2203/104* (2013.01); *F24F 2203/1036* (2013.01)

(58) Field of Classification Search

CPC ..... D21H 11/18; D21H 27/00; D21H 17/10; F24F 3/147; F24F 2203/104; F28F 13/18; F28F 21/00; F28D 21/0015; F28D 9/0062

USPC ..... 428/212, 292.4, 292.7, 218, 393, 372, 428/292.1, 296.1; 165/10, 54, 166, 905, 165/133, 186, 111

See application file for complete search history.

(56) References Cited

U.S. PATENT DOCUMENTS 4,484,938 A * 11/1984 Okamoto et al. ..... 96/118
4,490,732 A * 12/1984 Maekawa et al. ..... 503/200
4,582,129 A * 4/1986 Yano et al. ..... 96/118
4,888,092 A 12/1989 Prusas et al.
4,911,227 A * 3/1990 Saito et al. ..... 165/10
5,103,844 A 4/1992 Hayden et al.
5,109,876 A 5/1992 Hayden et al.
5,401,562 A * 3/1995 Akao ..... 428/211.1
5,709,774 A 1/1998 Naieni
5,843,566 A 12/1998 Miyauchi et al.
5,856,006 A * 1/1999 Asai et al. ..... 428/393
5,967,149 A 10/1999 Tsugaya et al.
6,074,523 A 6/2000 Mizobuchi et al.
6,138,684 A * 10/2000 Yamazaki et al. ..... 131/365
6,200,416 B1 * 3/2001 Brotto et al. ..... 162/4

FOREIGN PATENT DOCUMENTS

| | | | |
|---|---|---|---|
| DE | 197 49 867 A1 | | 5/1998 |
| EP | 0 829 692 | | 3/1998 |
| EP | 0829692 | * | 3/1998 |
| GB | 1268646 | * | 3/1972 |
| GB | 2 317 264 A | | 3/1998 |
| JP | 47-19990 | | 6/1972 |
| JP | 49-21746 | | 2/1974 |
| JP | 49-45882 | | 5/1974 |
| JP | 54-16054 | | 6/1979 |
| JP | 54-114481 | | 9/1979 |

(Continued)

OTHER PUBLICATIONS

AFT Aikawa Group Freeness Conversion Table, copyright 2013, accessed Feb. 11, 2016.*

Japanese Office Action mailed Mar. 19, 2010, with partial English Translation.

European Search Report dated Apr. 26, 2012, in counterpart EP Application No. 10179288.5.

(Continued)

*Primary Examiner* — Camie Thompson

(74) *Attorney, Agent, or Firm* — Kratz, Quintos & Hanson, LLP

(57) ABSTRACT

The object of the present invention is to provide an excellent total heat exchanging element paper and a total heat exchanging element which are excellent in heat transferability, water vapor permeability and gas barrier properties and cause no mixing of supplied air and discharged air. The present invention provides a total heat exchanging element paper using a paper made using mainly a natural pulp beaten to a Canadian modification freeness of not more than 150 ml, a substantially non-porous total heat exchanging element paper comprising a substantially non-porous cellulosic base which contains a moisture absorbing agent, a non-porous total heat exchanging element paper having a high gas barrier property which has a thickness of not more than 100 μm and a carbon dioxide permeation constant specified in JIS K7126 of not more than $5.0\times10^{-13}$ mol·m/m$^2$·s·Pa, and a non-porous total heat exchanging element paper having a high enthalpy exchangeability which has a water vapor permeability specified in JIS Z0208 of not less than 1000 g/m$^2$·24 Hr at 20° C. and 65% RH.

4 Claims, No Drawings

(56) References Cited

FOREIGN PATENT DOCUMENTS

| | | | |
|---|---|---|---|
| JP | 61-47354 | | 3/1986 |
| JP | 2639303 | | 7/1994 |
| JP | 6-89518 | | 11/1994 |
| JP | 7-113595 | | 5/1995 |
| JP | 7-42923 | | 8/1995 |
| JP | 09-265204 | * | 10/1997 |
| JP | 10-153399 | | 6/1998 |
| JP | 10-183492 | | 7/1998 |
| JP | 10-197185 | | 7/1998 |
| JP | 11-108409 | | 4/1999 |
| JP | 11-189999 | * | 7/1999 |

OTHER PUBLICATIONS

"Cigarette design and manufacture," http://www.bat.com/group/sites/uk_3mnfen.nsf/vwPagesWebLive/DO6S8JTV?opendocument&SKN=1, downloaded Sep. 2013.

"The Dictionary of Paper," American Paper and Pulp Association, Third Edition (1965), Cover Page and pp. 118-119.

Casey, James P., "Pulp and Paper," Chemistry and Chemical Technology, Third Edition (1981), vol. III, Cover Page and pp. 1754-1756.

Witham, Sr., G.S., "Modern Pulp and Paper Making," A Practical Treatise, Second Edition (1942), Cover Page and pp. 64-67.

* cited by examiner

TOTAL HEAT EXCHANGING ELEMENT PAPER

TECHNICAL FIELD

The present invention relates to a total heat exchanging element paper used for elements of total heat exchangers for carrying out heat exchange of sensible heat (temperature) and latent heat (humidity) in supplying fresh air to a room and simultaneously discharging the foul air in the room, which is superior in heat exchangeability and less in mixing of supplied air and discharged air, and to a total heat exchanging element using the above paper.

BACKGROUND ART

In heat exchangers between air and air which carry out heat exchanging in supplying fresh air to a room and simultaneously discharging the foul air from the room, the elements of total heat exchangers which carry out heat exchanging of latent heat (humidity) as well as sensible heat (temperature) are needed to have both heat transferability and moisture permeability, and, hence, in many cases, papers mainly composed of natural pulps are used.

Although the conventional total heat exchanging element papers have both the heat transferability and the moisture permeability, they have a problem that since porous bases are used, they also have permeability to foul gas components such as carbon dioxide, and supplied air and discharged air are mixed inside the elements in carrying out total heat exchanging to cause deterioration in efficiency of ventilation. The admixture of supplied air and discharged air is a fatal and serious defect in considering commercial products of total heat exchangers. If the supplied air and the discharged air mix with each other, it might be considered that the air inside the room and the air outside the room are not exchanged with carrying out recovery of energy, but the foul air inside the room is merely agitated with making a pretense of recovering heat. However the heat transferability may be high and however the moisture permeability may be high, if the air inside the room and the air outside the room mix with each other, ventilation cannot be performed, and, to say more bluntly, it can even be said that an electric fan can recover 100% of heat and humidity. It is a matter of course that an electric fan has no ventilating function, and the difference between a total heat exchanger which is a high-grade ventilating fan and an electric fan is simply that the former exchanges air inside a room and air outside the room without causing admixture of them while carrying out heat exchanging, in other words, it performs discharging of air from a room and supplying of air from outside. Since the value of the total heat exchangers as commercial products solely resides in the function of ventilation, the commercial value is fundamentally doubted if admixture of the supplied air and the discharged air occurs.

Various investigations have been made in an attempt to avoid the great problem of mixing of the supplied air and the discharged air. However, the total heat exchanging element papers until now have both heat transferability and moisture permeability, but are insufficient in gas barrier properties and cause considerable mixing of the supplied air and the discharged air inside the elements. This insufficient gas barrier property necessitates the use of paper (cellulose) bases in order to give moisture permeability to total heat exchanging element papers, and in order to further improve the moisture permeability, the total heat exchanging element papers must be made porous, resulting in increase of gas permeability (deterioration of gas barrier property). If the total heat exchanging element papers are not needed to have moisture permeability, not the porous bases such as papers, but plastic films which can be made thinner and are high in gas barrier property or metallic foils such as aluminum foils used in many heat exchange media will suffice for use. However, these materials are infinitely close to zero in moisture permeability, and, hence, they can perform heat exchange, but cannot perform moisture exchange, and thus cannot be used as total heat exchanging element papers.

Therefore, the object of the present invention is to provide a total heat exchanging element paper for constituting elements for total heat exchangers in which gas barrier property is enhanced with maintaining high moisture permeability and heat exchangeability and mixing of supplied air and discharged air in the element is diminished. That is, the object is to provide an excellent total heat exchanging element paper which satisfies all of the heat transferability, the moisture permeability and the gas barrier property, and further object is to provide a total heat exchanging element.

DISCLOSURE OF INVENTION

As a result of intensive research conducted by the inventors in an attempt to solve the above problems, the following total heat exchanging element papers and total heat exchanging elements have been invented.

(1) A total heat exchanging element paper which comprises a paper containing natural pulp beaten to a freeness of not more than 150 ml in Canadian modification freeness defined below:

Canadian modification freeness: a value obtained by carrying out the measurement in accordance with Canadian standard freeness testing method of JIS P8121, except that 0.5 g of a pulp in absolute dry weight is used and a plain weave bronze wire of 80 mesh is used as a sieve plate.

(2) A total heat exchanging element paper of (1) which additionally contains a moisture absorbing agent.

(3) A total heat exchanging element paper of (1) which has a density of not less than 0.9 g/cm$^3$.

(4) A total heat exchanging element paper of (2) which has a density of not less than 0.9 g/cm$^3$.

(5) A non-porous total heat exchanging element paper which comprises a substantially non-porous cellulosic base and a moisture absorbing agent contained in the base.

(6) A non-porous total heat exchanging element paper of (5) which has a thickness of not more than 100 μm and a carbon dioxide permeation constant specified in JIS K7126, method A (differential pressure method) of not more than $5.0\times10^{-13}$ mol·m/m$^2$·s·Pa.

(7) A non-porous total heat exchanging element paper of (5) which has a water vapor permeability of not less than 1000 g/m$^2$·24 Hr at 20° C. and 65% RH as specified in JIS Z0208.

(8) A non-porous total heat exchanging element paper of (6) which has a water vapor permeability of not less than 1000 g/m$^2$·24 Hr at 20° C. and 65% RH as specified in JIS Z0208.

(9) A non-porous total heat exchanging element paper of (5) wherein the base has a thickness of 8 μm-50 μm and is selected from the group consisting of condenser paper, tracing paper and glassine paper.

(10) A non-porous total heat exchanging element paper of (6) wherein the base has a thickness of 8 μm-50 μm and is selected from the group consisting of condenser paper, tracing paper and glassine paper.

(11) A non-porous total heat exchanging element paper of (7) wherein the base has a thickness of 8 μm-50 μm and is selected from the group consisting of condenser paper, tracing paper and glassine paper.

(12) A non-porous total heat exchanging element paper of (8) wherein the base has a thickness of 8 μm-50 μm and is selected from the group consisting of condenser paper, tracing paper and glassine paper.

(13) A total heat exchanging element using the total heat exchanging element paper of (1).

(14) A total heat exchanging element using the total heat exchanging element paper of (2).

(15) A total heat exchanging element using the total heat exchanging element paper of (3).

(16) A total heat exchanging element using the total heat exchanging element paper of (4).

(17) A total heat exchanging element using the total heat exchanging element paper of (5).

(18) A total heat exchanging element using the total heat exchanging element paper of (6).

(19) A total heat exchanging element using the total heat exchanging element paper of (7).

(20) A total heat exchanging element using the total heat exchanging element paper of (8).

(21) A total heat exchanging element using the total heat exchanging element paper of (9).

(22) A total heat exchanging element using the total heat exchanging element paper of (10).

(23) A total heat exchanging element using the total heat exchanging element paper of (11).

(24) A total heat exchanging element using the total heat exchanging element paper of (12).

BEST MODE FOR CARRYING OUT THE INVENTION

The total heat exchanging element paper of the present invention will be explained in detail below.

In the present invention, the total heat exchanging element papers which constitute the total heat exchanging elements include papers which constitute the portion of so-called partition plate in the case of corrugated type, or the portion which carries out exchanging of heat and humidity in the case of plastic frame incorporated type or embossed paper type. The total heat exchanging elements include those which are made using the total heat exchanging element papers of the present invention as partition plates or those which are made by incorporating plastic frames or embossing the total heat exchanging element papers.

The first aspect of the present invention will be explained.

The materials constituting the total heat exchanging element papers of the present invention mainly comprise cellulosic bases which are the same as general woodfree papers, and in the case of the total heat exchanging element papers of the above (1), it has been found that the total heat exchanging element papers excellent in heat transferability and water vapor permeability and in gas barrier property and causing substantially no mixing of supplied air and discharged air can be provided by using papers made of mainly a natural pulp beaten to a Canadian modification freeness of not more than 150 ml (the Canadian modification freeness being a value obtained by carrying out the measurement in accordance with the Canadian standard freeness testing method of JIS P8121, except that 0.5 g of a pulp in absolute dry weight is used and a plain weave bronze wire of 80 mesh is used as a sieve plate).

If a paper is made using mainly a natural pulp beaten to a Canadian modification freeness of more than 150 ml, the resulting paper is inferior in gas barrier properties, and if it is attempted to solve this defect, water vapor permeability becomes insufficient to cause deterioration of heat exchanging performance, and thus excellent total heat exchanging element papers cannot be obtained.

Moreover, it is preferred that the total heat exchanging element papers of the present invention contain a moisture absorbing agent. When the total heat exchanging element papers of the present invention contain a moisture absorbing agent, the moisture absorbability is synergistically improved, and thus the better total heat exchanging element papers cannot be obtained.

The pulp which is mainly used for the total heat exchanging element papers of the present invention is actually highly beaten to such a degree as lower than the lower limit measurable by the Canadian standard freeness testing method, namely, to the unmeasurable degree. Therefore, as a means to measure freeness of a pulp beaten to the degree unmeasurable by the Canadian standard freeness testing method, there is employed a Canadian modification freeness testing method which carries out the measurement in accordance with the Canadian standard freeness testing method of JIS P8121, except that 0.5 g of a pulp in absolute dry weight is used and a plain weave bronze wire of 80 mesh is used as a sieve plate.

The density of the total heat exchanging element papers of the present invention is preferably not less than 0.9 g/cm$^3$, more preferably not less than 1.0 g/cm$^3$ from the viewpoint of gas barrier property.

The second aspect of the present invention will be explained.

The materials constituting the total heat exchanging element papers of the present invention comprise mainly comprise cellulosic bases which are the same as general woodfree papers, and the difference from general papers or conventional total heat exchanging element papers is that porous bases are not used, but substantially non-porous bases are used.

As to the category of the substantially non-porous total heat exchanging element papers of the above (5), it is essential that according to, for example, a membrane test method, the carbon dioxide permeation constant specified in JIS K7126 is not more than $5.0\times10^{-13}$ mol·m/m$^2$·s·Pa. The carbon dioxide permeation constant guarantees a gas barrier property more than several hundred times that of the general papers or porous bases, and the fact that, for example, carbon dioxide which is a component of foul air hardly permeates through the total heat exchanging element papers which are used as partition plates satisfies the requirement that supplied air and discharged air do not mix with each other in the system of ventilation of the total heat exchanging elements.

In general, when papers have a high gas permeation constant, in many cases, not only gases (water vapor, carbon dioxide), but also heat easily permeate therethrough. This tendency can be readily understood when not a concept of membrane, but a porous base is considered. That is, in the case of a material having pores piercing therethrough, carbon dioxide and other gases, and furthermore water vapor and heat easily permeate through the pores together with transfer of air. The characteristics of easy permeation of water vapor and heat are readily acceptable characteristics in design of total heat exchangers because they satisfy the two important characteristics of total heat exchanging element papers, but the inventors have gone back to the starting point and have paid an attention to the fact that only water vapor and heat should permeate total heat exchanging element papers and carbon dioxide (a representative component of foil air and, in addition, ammonia, formaldehyde, etc.) should hardly permeate total heat exchanging element papers. The designing conception of the partition plate in this case (total heat exchanging element paper) is that the total heat exchanging element paper should never be a porous base having piercing pores and should have substantially no pores in the thickness direction in order for substantially no carbon dioxide permeating through the paper. Furthermore, since water (or water vapor) must be transferred in the sectional direction of the paper, and in the case of metal foils or plastic sheets, amount of water permeating therethrough is insufficient and, hence, a large amount of functional groups high in affinity for water molecules (e.g., hydroxyl groups, carboxylic acid groups, carboxylate groups, etc.) must be present in the sectional direction of the foils or sheets in order to assure the transferring amount of water. For obtaining such papers, it can be considered to use compounds high in affinity for water such as cellulose, polyvinyl alcohol, polyether, polyacrylic acid and salts thereof, etc., and cellulosic bases are most preferred for easily assuring the strength.

In order to make easy transfer of water in the sectional direction of paper (thickness direction), a moisture absorbing agent can be contained in the non-porous total heat exchanging element papers. When a moisture absorbing agent is contained in the total heat exchanging element papers of the present invention, the moisture absorbing agent and the functional groups high in affinity for water of molecules (e.g., cellulose) constituting the base synergistically act, and there can be obtained further excellent total heat exchanging element papers. As the moisture absorbing agents, there may be used any of those which are generally known, such as halides, oxides, salts, hydroxides, etc., and most preferred are lithium chloride, calcium chloride, phosphates, etc. because of their superior moisture absorbing efficiency. Some of these compounds have flame retardance and they may be added for imparting flame retardance to the bases.

The non-porous total heat exchanging element papers of the present invention are characterized in that they have a thickness of not more than 100 μm and a carbon dioxide permeation constant specified in JIS K7126 of not more than $5.0\times10^{-13}$ mol·m/m$^2$·s·Pa. Naturally, the gas permeation constant of carbon dioxide or the like is an indication of selective permeability of mainly gases peculiar to the molecular structures of polymeric bases, and, therefore, thickness has no relation thereto as can be seen from its unit system. Since the actual gas permeation amount is in inverse proportion to the thickness of the base used, in the case of reducing the permeation amount of carbon dioxide, the total heat exchanging element papers are higher in carbon oxide barrier property with increase of thickness. However, simultaneously with increase in thickness of the total heat exchanging element papers, permeability to water vapor reduces and hence the function as the total heat exchanging elements become unsatisfactory. Therefore, such a thickness which does not damage the heat exchangeability is necessary, and thus the limitation in the above (6) is the same as the meaning that the carbon dioxide permeation constant specified in JIS K7126 is not more than $5.0\times10^{-9}$ mol/m$^2$·s·Pa under the condition of a thickness of not more than 100 μm. If the thickness is more than 100 μm, the important heat exchangeability is deteriorated, and if it is too thin, there are high possibilities of causing structural defects and producing pin holes at the time of working, thereby to cause deterioration of gas barrier property, resulting in deviation from the object of heat exchanging. However, the lower limit of thickness is omitted because it can be specified by the upper limit of the carbon dioxide permeation constant.

The total heat exchanging element papers of the present invention are required to be substantially non-porous. Although there is no clear definition on whether the total heat exchanging element papers are non-porous or porous in the thickness direction of the papers, the standard in the present specification is that the total heat exchanging element papers have a thickness of not more than 100 μm and a carbon dioxide permeation constant specified in JIS K7126 of not more than $5.0\times10^{-13}$ mol·m/m$^2$·s·Pa. As mentioned above, this value is synonymous with a carbon dioxide permeation constant of not more than $5.0\times10^{-9}$ mol/m$^2$·s·Pa. Carbon dioxide permeation constant of the generally known porous total heat exchanging element papers is several hundred times to scores of thousands times the above value, and, hence, it is clear that the total heat exchanging element papers of the present invention are far from the conception of the conventional total heat exchanging element papers.

Furthermore, the total heat exchanging element papers of the present invention have the characteristics that the water vapor permeability at 20° C. and 65% RH as specified in JIS Z0208 is not less than 1000 g/m$^2$·24 Hr, namely, they have a heat exchangeability of high enthalpy. Only such characteristics that the total heat exchanging element papers should be non-porous, and should have a thickness of not more than 100 μm and a carbon dioxide permeation constant specified in JIS K7126 of not more than $5.0\times10^{-13}$ mol·m/m$^2$·s·Pa can be attained by simple polyethylene films and polyester films. The great characteristics of the total heat exchanging element papers of the present invention are that they have water vapor permeability comparable to water vapor permeability of the conventional total heat exchanging element papers through which gases easily permeate while they have the gas barrier property comparable to that of plastic films. This conforms to the idea of the selective gas permeation membranes which accelerate permeation of only water with inhibiting permeation of all gases.

Furthermore, third aspect of the present invention will be explained.

In the present invention, preferred are non-porous total heat exchanging element papers which are condenser paper, tracing paper or glassine paper having a thickness of 8 μm-50 μm and containing a moisture absorbing agent.

The materials of the condenser paper, tracing paper or glassine paper constituting the total heat exchanging element papers of the present invention are mainly cellulosic bases which are the same as general woodfree papers, and the difference from general papers and conventional total heat exchanging element papers is that not a porous base, but a condenser paper, a tracing paper or a glassine paper which is substantially non-porous is used. A standard for the category of "substantially non-porous" can be considered that the carbon dioxide permeation constant specified in JIS K7126 of membrane test method is not more than $5.0\times10^{-13}$ mol·m/m$^2$·s·Pa. This carbon dioxide permeation constant guarantees a gas barrier property of not less than several hundred times that of so-called general papers or porous bases. This barrier property means that, for example, carbon dioxide which is a component of foul air hardly permeates the total heat exchanging element papers which are used as partition plates and satisfies the requirement that supplied air and discharged air do not mix with each other in the system of ventilation of the total heat exchanging elements.

In general, when papers have a high gas permeation constant, in many cases, not only gases (water vapor, carbon dioxide), but also heat easily permeate therethrough. This tendency can be readily understood when not a concept of membrane, but a porous base is taken into consideration. That is, in the case of a material having piercing pores, carbon dioxide and other gases, and, furthermore, water vapor and heat easily permeate through the pores together with transfer of air. The characteristic in designing of total heat exchangers because they satisfy the two important characteristics of total heat exchanging element papers, but the inventors have gone back to the starting point that the total heat exchangers are heat exchanging type ventilating fans, and have paid an attention to the point that only water vapor (latent heat) and heat (sensible heat) should permeate the total heat exchanging element papers and carbon dioxide (a representative component of foul air and, in addition, ammonia, formaldehyde, etc.) should hardly permeate the total heat exchanging element papers. The conception of designing the partition plate in this case (total heat exchanging element paper) is that the total heat exchanging element paper should never be a porous base having piercing pores and should have substantially no pores in the thickness direction in order for substantially no carbon dioxide permeating through the paper. Furthermore, since water (or water vapor) must be transferred in the sectional direction of the paper, in the case of metal foils or plastic sheets, amount of the transferring water is insufficient and a large amount of functional groups high in affinity for water molecules (e.g., hydroxyl groups, carboxylic acid groups, carboxylate groups, etc.) must be present in the sectional direction of the foils or sheets. For such papers, it can be considered to use compounds high in affinity for water such as cellulose, polyvinyl alcohol, polyether, polyacrylic acid and salts thereof, etc., and cellulosic bases are most preferred for easy working and easy assuring of strength. In the present invention, among the papers using cellulosic bases, non-porous condenser papers, tracing papers or glassine papers having a specific thickness are particularly preferred as bases.

In order to make easy the transfer of water in the sectional direction of paper (thickness direction), a moisture absorbing agent can be contained in the non-porous condenser papers, tracing papers or glassine papers. When the moisture absorbing agent is contained in the total heat exchanging element papers of the present invention, the moisture absorbability of the moisture absorbing agent and the functional groups high in affinity for water of molecules (e.g., cellulose) constituting the base synergistically act, resulting in more excellent total heat exchanging element papers.

The non-porous total heat exchanging element papers of condenser paper type, tracing paper type or glassine paper type of the present invention are characterized by having a thickness of 8 μm-50 μm. If the thickness is less than this range, the probability of forming pin holes increases to cause mixing of the supplied air and the discharged air, and they are not preferred as the total heat exchanging element papers. If the thickness is more than the above range, heat exchangeability and moisture permeability are deteriorated and the papers are also not preferred as the total heat exchanging element papers.

The total heat exchanging element papers of the present invention are required to be substantially non-porous. There is no clear definition as to whether the total heat exchanging element paper is non-porous or porous in the thickness direction thereof, and it can be judged by whether pores are clearly present in the thickness direction in a sectional enlarged photograph of the paper or by employing the gas permeation constant of gases such as carbon dioxide as a standard. Since condenser papers, tracing papers or glassine papers are also needed to be free from pin holes, it is a standard that the carbon dioxide permeation constant specified in JIS K7126 is not more than $5.0\times10^{-13}$ mol·m/m$^2$·s·Pa. In the case of porous papers, the permeation constant is more than 100 times the above value, and thus discrimination will be easy.

The total heat exchanging element papers of the present invention has the features that they are high in heat transferability and humidity exchangeability and less in leakage, and hence are of very high enthalpy exchangeability. Only such characteristics that they are non-porous, have a thickness of not more than 50 μm, and have a carbon dioxide permeation constant of not more than a specific value can also be attained by simple polyethylene films or polyester films. The great characteristics of the total heat exchanging element papers of the present invention are that while they have gas barrier property comparable to that of plastic films, they also have a water vapor permeability comparable to water vapor permeability of the conventional total heat exchanging element papers through which gases easily permeate. This conforms to the way of thinking on selective gas permeation membranes which accelerate only the permeation of water while inhibiting permeation of all the gases.

The condenser papers used in the present invention are generally used for electrically insulating papers such as, for example, insulating papers for communication cables, transformers and winding wires, kraft insulating papers, and modified kraft insulating papers. Main uses thereof are communication condensers, power condensers, power cable condensers, etc. The main constituting component is cellulose, but those which contain vinylon or cotton may also be used.

According to a method for producing the condensers, a pulp of good quality is beaten in viscous state, made into a paper and subjected to supercalendering to obtain a non-porous high density paper which is uniform in thickness, free from wrinkles, cloudiness, pin holes and breakage, and high in strength. It is preferred to produce a non-porous paper of high density of not less than 0.8 g/cm$^3$, preferably not less than 0.9 g/cm$^3$, and about 0.9-1.27 g/cm$^3$ considering the production efficiency. For the uses of the present invention, a moisture absorbing agent may be contained in the paper.

The tracing papers used in the present invention are generally used for intermediate papers such as diazo type papers, drafting papers, decorative papers, etc., for which writability, erasability, transparency, reproducibility, toner receptivity, and strength are taken into consideration. The tracing papers include general tracing papers (natural tracing papers) prepared by making into a paper a pulp mainly composed of NBKP or the like and subjected to beating and impregnated tracing papers which are enhanced in transparency by impregnating with resins. The tracing papers used for the purpose of the present invention are mainly former tracing papers, and it is preferred to produce non-porous papers of high density of not less than 0.8 g/cm$^3$, preferably not less than 0.9 g/cm$^3$, and about 0.9-1.27 g/cm$^3$ considering the production efficiency. For the uses of the present invention, a moisture absorbing agent may be contained in the papers.

The glassine papers used in the present invention are used for wrapping of foods, wrapping of medicines, cups for cakes (punched papers), decoration, etc., and they are superior to general papers in oil resistance, transparency, water vapor permeability, etc.

As an example of the method for producing the glassine paper in the present invention, a natural pulp such as chemical pulp is beaten in highly viscous state, made into a paper, and subjected to moistening so as to obtain a water content of 25% and calendering treatment to increase the density and simultaneously to release air bubbles in the paper layer, thereby removing pin holes and enhancing transparency. It is preferred to produce non-porous papers of high density of not less than 0.8 g/cm$^3$, preferably not less than 0.9 g/cm$^3$, and about 0.9-1.27 g/cm$^3$ considering the production efficiency. For the uses of the present invention, a moisture absorbing agent may be contained in the papers.

The first to third aspects of the present invention will be further explained below.

As the moisture absorbing agents used in the present invention, there may be used any of halides, oxides, salts, hydroxides, etc. which are generally known, and lithium chloride, calcium chloride, phosphates, etc. are especially preferred because they are good in moisture absorbability. Some of these compounds have an effect of flame retardation, and the present invention includes addition of these compounds for imparting flame retardance to the papers. The amount of the moisture absorbing agent varies depending on the thickness of the non-porous condenser papers, tracing papers and glassine papers, and cannot be numerically limited, but in general the moisture absorbability as total heat exchanging element papers increases with increase of the amount of the moisture absorbing agent.

As the natural pulp mainly used for the total heat exchanging element papers of the present invention and the materials used as cellulosic bases, mention may be made of NBKP, LBKP, NBSP, LBSP, NUKP, etc. These may be used each alone or in admixture depending on purposes. Furthermore, of necessary, there may also be used non-wood pulps such as cotton fibers, bast fibers, bagasse, and hemp. The mixing ratio in the case of mixing the pulps can be optionally varied depending on the purposes. Moreover, a small amount of thermoplastic synthetic fibers may also be used to enhance strength and molding processability.

The pulp in the present invention is beaten by a beater such as double disc refiner, deluxe finer and Jordan until internal fibrillation and external fibrillation occur, and then made into a paper.

In making the paper, there may be added a small amount of a wet strengthening agent for increasing wet strength, internal sizing agent for increasing paper strength, etc.

When a paper is made using the beaten pulp in the present invention, there may be employed paper machines such as Fourdrinier machine, cylinder machine, twin-wire former, on-top machine and hybrid machine. It is preferred for improving uniformity of the paper to carry out supercalendering or hot-calendering after making the paper.

The total heat exchanging elements in the present invention may be of any structures as long as the papers obtained as mentioned above are used as the heat exchanging media. The corrugate structure which is a representative structure of the total heat exchanging elements is a structure in which the total heat exchanging element papers of the present invention are used as liner sheets and they are laminated so that the corrugation directions of the sheets of inner core are cross each other.

The present invention will be explained in detail by the following examples. The present invention is not limited by the examples. In the examples, all parts and % are by weight. The value which indicates coating amount is the weight after drying unless otherwise notified.

(1) The first aspect:

EXAMPLE 1

Soft wood bleached kraft pulp (NBKP) was macerated at a concentration of 3% and then beaten by a double disc refiner and a deluxe finer until the Canadian modification freeness of the pulp reached 100 ml. Thereafter, a total heat exchanging element paper having a basis weight of 40 g/m$^2$ was produced by a Fourdrinier paper machine. By a size press, 1 g/m$^2$ of lithium chloride was coated, followed by subjecting to machine calendering treatment so as to give a density of 0.9 g/cm$^3$.

EXAMPLE 2

A total heat exchanging element paper was obtained in the same manner as in Example 1, except that the Canadian modification freeness of the pulp was changed to 150 ml.

EXAMPLE 3

A total heat exchanging element paper was obtained in the same manner as in Example 1, except that the Canadian modification freeness of the pulp was changed to 50 ml.

EXAMPLE 4

A total heat exchanging element paper was obtained in the same manner as in Example 1, except that diammonium phosphate was used in place of lithium chloride.

EXAMPLE 5

A total heat exchanging element paper was obtained in the same manner as in Example 1, except that starch in an amount of 0.1 g/m$^2$ was used in place of lithium chloride.

EXAMPLE 6

A total heat exchanging element paper was obtained in the same manner as in Example 1, except that the machine calendering treatment was carried out to give a density of 0.8 g/cm$^3$.

EXAMPLE 7

A total heat exchanging element paper was obtained in the same manner as in Example 1, except that the Canadian modification freeness of the pulp was changed to 200 ml.

The total heat exchanging element papers obtained in the above Examples were evaluated by the following evaluation methods. The results are shown in Table 1.

(Canadian Modification Freeness)

The Canadian modification freeness of the pulp was measured in accordance with Canadian standard freeness testing method of JIS P8121, except that 0.5 g of a pulp in absolute dry weight was used and a bronze wire of 80 mesh was used as a sieve plate.

(Water Vapor Permeability)

Sensible heat (humidity) exchangeability of the total heat exchanging element paper was evaluated in terms of water vapor permeability. The water vapor permeability at 40° C., 90% of the total heat exchanging element paper was measured in accordance with JIS Z0208, except that the water vapor permeability was obtained by measuring the weight every 1 hour since the water vapor permeability was great.

(Quantity of Heat Transfer)

Latent heat (temperature) exchangeability of the total heat exchanging element paper was evaluated in terms of quantity of heat transfer, which was measured by QTM method (probe method which was an improved hot-wire method).

(Carbon Dioxide Permeability)

Gas barrier property of the total heat exchanging element paper was evaluated in terms of carbon dioxide permeability, which was measured in accordance with method A (differential pressure method) of JIS K7126. In Table 1, the expression "$10^{-7}$ or more and unmeasurable" means that when the permeability was $10^{-7}$ mol/m$^2$·s·Pa or more, the permeation was too rapid and the permeability could not be measured.

TABLE 1

| | Canadian modification freeness ml | Density g/cm$^3$ | Water vapor permeability g/m$^2$ · 24 h | Quantity of heat transfer W/° C. | Carbon dioxide permeability mol/m$^2$ · s · Pa |
|---|---|---|---|---|---|
| Example 1 | 100 | 0.9 | 6200 | 12800 | $1.0 \times 10^{-10}$ |
| Example 2 | 150 | 0.9 | 6300 | 12200 | $3.4 \times 10^{-9}$ |
| Example 3 | 50 | 0.9 | 6200 | 13200 | $2.8 \times 10^{-10}$ |
| Example 4 | 100 | 0.9 | 6100 | 12900 | $1.1 \times 10^{-10}$ |
| Example 5 | 100 | 0.9 | 5000 | 12800 | $1.2 \times 10^{-10}$ |
| Example 6 | 100 | 0.8 | 5900 | 12000 | $1.0 \times 10^{-9}$ |
| Example 7 | 200 | 0.9 | 6300 | 11500 | Not less than $10^{-7}$ and unmeasurable |

(Evaluation)

It is clear from the results of Examples 1-7 that the total heat exchanging element papers of the present invention are excellent in heat transferability, water vapor permeability and gas barrier property. On the other hand, it is clear that when the Canadian modification freeness of pulp is greater than 150 ml, the carbon dioxide permeability is great and the paper is much inferior in gas barrier property to the papers of the present invention. It is further clear that when a moisture absorbing agent is contained, the water vapor permeability synergistically increases without damaging other performances, and papers higher in heat exchangeability can be obtained. Furthermore, it can be seen that when the density is not less than 0.9 g/cm$^3$, the carbon dioxide permeability decreases and this is preferred from the viewpoint of gas barrier property.

(1) The second aspect:

EXAMPLE 8

Soft wood bleached kraft pulp (NBKP) was macerated at a concentration of 2.8% and then sufficiently beaten by a double disc refiner and a deluxe finer. Thereafter, a base paper having a basis weight of 40 g/m$^2$ was produced by a Fourdrinier paper machine. At the production step, 5 g/m$^2$ of a diammonium phosphate solution was coated as a moisture absorbing agent, followed by drying to obtain a total heat exchanging element paper 1. This total heat exchanging element paper was substantially non-porous, and had a carbon dioxide permeation constant of $5.0\times10^{-13}$ mol·m/m$^2$·s·Pa measured in accordance with method A (differential pressure method) of JIS K7126 and a thickness of 45 μm.

EXAMPLE 9

A base paper having a basis weight of 40 g/m$^2$ was produced by a Fourdrinier paper machine in the same manner as in Example 8, except that the beating was more sufficiently carried out. At the production step, 5 g/m$^2$ of a diammonium phosphate solution was coated as a moisture absorbing agent, followed by drying to obtain a total heat exchanging element paper 2. This total heat exchanging element paper was substantially non-porous, and had a carbon dioxide permeation constant of $5.0\times10^{-14}$ mol·m/m$^2$·s·Pa measured in accordance with method A (differential pressure method) of JIS K7126 and a thickness of 45 μm.

EXAMPLE 10

A base paper was produced in the same manner as in Example 9, except that the basis weight was 20 g/m$^2$. At the production step, 3 g/m$^2$ of a diammonium phosphate solution was coated as a moisture absorbing agent, followed by drying to obtain a total heat exchanging element paper 3. This total heat exchanging element paper was substantially non-porous, and had a carbon dioxide permeation constant of $5.0\times10^{-14}$ mol·m/m$^2$·s·Pa measured in accordance with method A (differential pressure method) of JIS K7126.

EXAMPLE 11

A base paper was produced in the same manner as in Example 9, except that the basis weight was 20 g/m$^2$. At the production step, 4 g/m$^2$ in total of a diammonium phosphate solution and lithium chloride were coated as moisture absorbing agents, followed by drying to obtain a total heat exchanging element paper 4. This total heat exchanging element paper was substantially non-porous, and had a carbon dioxide permeation constant of $5.0\times10^{-14}$ mol·m/m$^2$·s·Pa measured in accordance with method A (differential pressure method) of JIS K7126 and a thickness of 25 μm.

EXAMPLE 12

A base paper was produced in the same manner as in Example 9, except that the basis weight was 100 g/m$^2$. At the production step, 10 g/m$^2$ in total of a diammonium phosphate solution and lithium chloride were coated as moisture absorbing agents, followed by drying to obtain a total heat exchanging element paper 5. This total heat exchanging element paper was substantially non-porous, and had a carbon dioxide permeation constant of $5.0\times10^{-14}$ mol·m/m$^2$·s·Pa measured in accordance with method A (differential pressure method) of JIS K7126 and a thickness of 110 μm.

EXAMPLE 13

A base paper was produced in the same manner as in Example 12, except that the basis weight was 150 g/m$^2$. At the production step, 15 g/m$^2$ in total of a diammonium phosphate solution and lithium chloride were coated as moisture absorbing agents, followed by drying to obtain a total heat exchanging element paper 6. This total heat exchanging element paper was substantially non-porous, and had a carbon dioxide permeation constant of $5.0\times10^{-14}$ mol·m/m$^2$·s Pa measured in accordance with method A (differential pressure method) of JIS K7126 and a thickness of 165 μm.

EXAMPLE 14

Total heat exchanging elements of corrugate type were produced using the total heat exchanging element papers produced in Examples 8-13 as partition plates and woodfree papers of 75 g/m$^2$ as flute portions. There were no problems in production and the elements functioned satisfactorily.

EXAMPLE 15

Soft wood bleached kraft pulp (NBKP) was macerated at a concentration of 3% and then moderately beaten by a double disc refiner. Thereafter, a base paper having a basis weight of 40 g/m$^2$ was produced by a Fourdrinier paper machine. At the production step, 5 g/m$^2$ of a diammonium phosphate solution was coated as a moisture absorbing agent, followed by drying to obtain a total heat exchanging element paper 7. This total heat exchanging element paper was substantially porous, and had a carbon dioxide permeation constant of $1.0\times10^{-9}$ mol·m/m$^2$·s·Pa measured in accordance with method A (differential pressure method) of JIS K7126 and a thickness of 45 μm.

EXAMPLE 16

A base paper was produced in the same manner as in Example 15, except that the basis weight was 20 g/m$^2$. At the production step, 3 g/m$^2$ of a diammonium phosphate solution was coated as a moisture absorbing agent, followed by drying to obtain a total heat exchanging element paper 8. This total heat exchanging element paper was substantially porous, and had a carbon dioxide permeation constant of $1.0\times10^{-9}$ mol·m/m$^2$·s·Pa measured in accordance with method A (differential pressure method) of JIS K7126 and a thickness of 25 μm.

EXAMPLE 17

A base paper was produced in the same manner as in Example 15, except that the basis weight was 100 g/m$^2$. At the production step, 10 g/m$^2$ in total of a diammonium phosphate solution and lithium chloride were coated as moisture absorbing agents, followed by drying to obtain a total heat exchanging element paper 9. This total heat exchanging element paper was substantially porous, and had a carbon dioxide permeation constant of $1.0\times10^{-9}$ mol·m/m$^2$·s·Pa measured in accordance with method A (differential pressure method) of JIS K7126 and a thickness of 115 μm.

EXAMPLE 18

A base paper was produced in the same manner as in Example 15, except that the basis weight was 100 g/m$^2$. At the production step, first, PVA was coated in an amount of 3 g/m$^2$ and dried, and then 10 g/m$^2$ in total of a diammonium phosphate solution and lithium chloride were coated as moisture absorbing agents, followed by drying to obtain a total heat exchanging element paper 10. This total heat exchanging element paper was substantially non-porous, and had a carbon dioxide permeation constant of $1.0\times10^{-10}$ mol·m/m$^2$·s·Pa measured in accordance with method A (differential pressure method) of JIS K7126 and a thickness of 115 μm.

The total heat exchanging element papers produced in the above Examples were evaluated by the following evaluation methods. The results are shown in Table 2.

(Water Vapor Permeability)

Evaluation was conducted in the same manner as in Examples 1-7. This water vapor permeability is a value indicating humidity exchangeability, and the larger value means the better exchangeability.

(Quantity of Heat Transfer)

Evaluation was conducted in the same manner as in Examples 1-7. This quantity of heat transfer is an indication representing heat exchangeability, and the larger value means the better exchangeability.

(Gas Barrier Property: Leakage Amount of Carbon Dioxide)

In the same manner as in Example 14, total heat exchanging elements of corrugate type were produced using the total heat exchanging element papers produced in Examples 8-13 and 15-18 as partition plates and woodfree papers of 75 g/m$^2$ as flute portions. A synthetic air gas containing nitrogen and oxygen at 79:21 was allowed to pass from the air supplying side of the total heat exchanging elements and a foul gas containing carbon dioxide at a given concentration was allowed to pass from the air discharging side to perform ventilation. Concentration of carbon dioxide at the exit of the air supplying side was measured and this concentration was compared with the concentration of carbon dioxide at the inlet of the air discharging side, and the amount of carbon dioxide which leaked was calculated and shown by %. When the amount of the leaking carbon dioxide was 5% or more, this was indicated by "x"; when it was 1% or more and less than 5%, this was indicated by "Δ"; when it was 0.1% or more and less than 1%, this was indicated by "o"; and when it was less than 0.1%, this was indicated by "◎".

TABLE 2

| | Water vapor permeability g/m$^2$ · 24 h | Quantity of heat transfer W/° C. | Leakage amount of carbon dioxide |
|---|---|---|---|
| Example 8 | 6300 | 13000 | ◎ |
| Example 9 | 6300 | 13500 | ◎ |
| Example 10 | 7500 | 25000 | ◎ |
| Example 11 | 8500 | 26000 | ◎ |
| Example 12 | 5000 | 5500 | ◎ |
| Example 13 | 4500 | 3000 | ◎ |
| Example 15 | 6200 | 12500 | X |
| Example 16 | 6200 | 20000 | X |
| Example 17 | 5000 | 5000 | X |
| Example 18 | 5000 | 5000 | Δ |

(Evaluation)

It is clear from the results of Examples 8-13 and 15-18 that the total heat exchanging elements using the non-porous total heat exchanging element papers of the present invention are excellent in heat transferability, water vapor permeability and gas barrier property. It is clear that in the case of using porous type papers, when the thickness is increased or a binder is mixed to fill the pores, the amount of leaking carbon dioxide can be reduced, but simultaneously the water vapor permeability and the quantity of heat transfer decrease, and thus satisfactory total heat exchanging element papers cannot be obtained, and, besides, the leakage of carbon dioxide in the case of using the porous type papers is extremely greater than that in the case of using the non-porous total heat exchanging element papers of the present invention and the gas barrier property of the porous type papers is considerably inferior to the papers of the present invention. Since the total heat exchanging element papers of the present invention are basically non-porous, even when the thickness is reduced, they have sufficient carbon dioxide barrier property, and by reducing the thickness, both water vapor permeability and quantity of heat transfer (heat exchangeability) are improved, resulting in satisfactory total heat exchanging element papers. The total heat exchanging elements using the total heat exchanging element papers of the present invention satisfactorily perform exchanging of heat and water without causing mixing of supplied air and discharged air from outside and inside of a room, and thus can provide high total heat exchanging function.

(3) The third aspect:

EXAMPLE 19

A condenser paper having a basis weight of 20 g/m$^2$ was coated with 10 g/m$^2$ of a 50 wt % diammonium phosphate solution as a moisture absorbing agent, followed by drying to obtain a condenser paper type total heat exchanging element paper 11. This condenser paper type total heat exchanging element paper had a carbon dioxide permeation constant of not more than $5.0\times10^{-13}$ mol·m/m$^2$·s·Pa measured in accordance with method A (differential pressure method) of JIS K7126, was substantially non-porous and had a thickness of 20 μm.

EXAMPLE 20

In the same manner as in Example 19, a condenser paper having a basis weight of 50 g/m$^2$ was coated with 30 g/m$^2$ of a diammonium phosphate solution as a moisture absorbing agent, followed by drying to obtain a condenser paper type total heat exchanging element paper 12. This condenser paper type total heat exchanging element paper had a carbon dioxide permeation constant of not more than $5.0\times10^{-13}$ mol·m/m$^2$·s·Pa measured in accordance with method A (differential pressure method) of JIS K7126, was substantially non-porous, and had a thickness of 50 μm.

EXAMPLE 21

In the same manner as in Example 19, a condenser paper having a basis weight of 8 g/m$^2$ was coated with 4 g/m$^2$ in total of a 50 wt % diammonium phosphate solution and a 50 wt % lithium chloride solution as moisture absorbing agents, followed by drying to obtain a condenser paper type total heat exchanging element paper 13. This condenser paper type total heat exchanging element paper had a carbon dioxide permeation constant of not more than $5.0\times10^{-13}$ mol·m/m$^2$·s·Pa measured in accordance with method A (differential pressure method) of JIS K7126, was substantially non-porous, and had a thickness of 8 μm.

EXAMPLE 22

A typewriter paper having a basis weight of 16 g m$^2$ and a density of 0.65 g/cm$^3$ was coated with 10 g/m$^2$ of a 50 wt % diammonium phosphate solution as a moisture absorbing agent, followed by drying to obtain a total heat exchanging element paper 14. This condenser paper type total heat exchanging element paper had a carbon dioxide permeation constant of more than $5.0\times10^{-11}$ mol·m/m$^2$·s·Pa measured in accordance with method A (differential pressure method) of JIS K7126, was substantially porous and had a thickness of 20 μm.

EXAMPLE 23

In the same manner as in Example 22, a typewriter paper having a basis weight of 40 g/m$^2$ was coated with 30 g/m$^2$ of a 50 wt % diammonium phosphate solution as a moisture absorbing agent, followed by drying to obtain a total heat exchanging element paper 15. This condenser paper type total heat exchanging element paper had a carbon dioxide permeation constant of more than $5.0\times10^{-11}$ mol·m/m$^2$·s·Pa measured in accordance with method A (differential pressure method) of JIS K7126, was substantially porous and had a thickness of 50 μm.

EXAMPLE 24

In the same manner as in Example 22, an ultra-thin typewriter paper having a basis weight of 8 g/m$^2$ was coated with 4 g/m$^2$ in total of a 50 wt % diammonium phosphate solution and a 50 wt % lithium chloride solution as moisture absorbing agents, followed by drying to obtain a total heat exchanging element paper 16. This condenser paper type total heat exchanging element paper had a carbon dioxide permeation constant of more than $5.0\times10^{-11}$ mol·m/m$^2$·s·Pa measured in accordance with method A (differential pressure method) of JIS K7126, was substantially porous, and had a thickness of 10 μm.

EXAMPLE 25

A condenser paper having a basis weight of 75 g/m$^2$ was coated with 50 g/m$^2$ of a 50 wt % diammonium phosphate solution as a moisture absorbing agent, followed by drying to obtain a condenser paper type total heat exchanging element paper 17. This condenser paper type total heat exchanging element paper had a carbon dioxide permeation constant of not more than $5.0\times10^{-13}$ mol·m/m$^2$·s·Pa measured in accordance with method A (differential pressure method) of JIS K7126, was substantially non-porous and had a thickness of 75 μm.

EXAMPLE 26

A condenser paper having a basis weight of 5 g/m$^2$ was coated with 2.6 g/m$^2$ of a 50 wt % diammonium phosphate solution and a lithium chloride solution as moisture absorbing agents, followed by drying to obtain a condenser paper type total heat exchanging element paper 18. This condenser paper type total heat exchanging element paper had a carbon dioxide permeation constant of more than $5.0\times10^{-11}$ mol·m/m$^2$·s·Pa measured in accordance with method A (differential pressure method) of JIS K7126, was substantially porous, and had a thickness of 5 μm.

The total heat exchanging element papers produced in the above Examples were evaluated by the following evaluation methods. The results are shown in Table 3.

(Water Vapor Permeability)

Evaluation was conducted in the same manner as in Examples 1-7.

(Quantity of Heat Transfer)

Evaluation was conducted in the same manner as in Examples 1-7.

(Gas Barrier Property: Leakage Amount of Carbon Dioxide)

Evaluation was conducted in the same manner as in Examples 8-13 and 15-18.

TABLE 3

| | Condenser paper or other paper | Thickness μm | Water vapor permeability g/m$^2$ · 24 h | Quantity of heat transfer W/° C. | Leakage amount of carbon dioxide |
|---|---|---|---|---|---|
| Example 19 | Condenser paper | 20 | 7800 | 28000 | ◎ |
| Example 20 | Condenser paper | 50 | 6000 | 12000 | ◎ |
| Example 21 | Condenser paper | 8 | 15500 | 42000 | ◎ |
| Example 22 | Typewriter paper | 20 | 6200 | 22500 | X |
| Example 23 | Typewriter paper | 50 | 5000 | 10000 | X |
| Example 24 | Typewriter paper | 10 | 10500 | 38000 | X |
| Example 25 | Condenser paper | 75 | 2000 | 6000 | ◎ |
| Example 26 | Condenser paper | 5 | 16000 | 44000 | X |

(Evaluation)

It is clear from the results of Examples 19-21 and 22-26 that the total heat exchanging elements using the condenser type non-porous total heat exchanging element papers of the present invention are excellent in heat transferability, water vapor permeability and gas barrier property. It is clear that in the case of using porous type papers without using the condenser papers, when the thickness is increased or a binder is mixed to fill the pores, the amount of leaking carbon dioxide can be reduced, but simultaneously the water vapor permeability and the quantity of heat transfer decrease, and thus satisfactory total heat exchanging element papers cannot be obtained, and, besides, the leakage amount of carbon dioxide in the case of using the porous type papers is extremely greater than that in the case of using the non-porous total heat exchanging element papers of the present invention and the gas barrier property of the porous type papers is considerably inferior to the papers of the present invention. Since the condenser paper type total heat exchanging element papers of the present invention are basically non-porous, even when the thickness is reduced, they have sufficient carbon dioxide barrier property, and by reducing the thickness, both water vapor permeability and heat transfer (heat exchangeability) are improved, resulting in satisfactory total heat exchanging element papers. The total heat exchanging elements using the total heat exchanging element papers of the present invention satisfactorily perform exchanging of heat and water without causing mixing of air supplied from outside of a room and air discharged from inside of a room, and thus can provide high total heat exchanging function. Furthermore, the papers having a thickness within the range of the present invention can give good heat transferability, water vapor permeability and gas barrier property. If the thickness is more than that of the present invention, the gas barrier property is sufficient, but the heat transferability and the water vapor permeability are not sufficient, and thus the papers are not preferred as total heat exchanging element papers. If the thickness is less than that of the present invention, the gas barrier property is not sufficient probably because of formation of pin holes, and thus the papers are also not preferred as total heat exchanging element papers.

EXAMPLE 27

A tracing paper having a basis weight of 20 g/m$^2$ was coated with 12 g m$^2$ of a 50 wt % diammonium phosphate solution as a moisture absorbing agent, followed by drying to obtain a tracing paper type total heat exchanging element paper 19. This tracing paper type total heat exchanging element paper had a carbon dioxide permeation constant of not more than $5.0\times10^{-13}$ mol·m/m$^2$·s·Pa measured in accordance with method A (differential pressure method) of JIS K7126, was substantially non-porous and had a thickness of 20 μm.

EXAMPLE 28

In the same manner as in Example 27, a tracing paper having a basis weight of 50 g/m$^2$ was coated with 33 g/m$^2$ of a 50 wt % diammonium phosphate solution as a moisture absorbing agent, followed by drying to obtain a tracing paper type total heat exchanging element paper 20. This tracing paper type total heat exchanging element paper had a carbon dioxide permeation constant of not more than $5.0\times10^{-13}$ mol·m/m$^2$·s·Pa measured in accordance with method A (differential pressure method) of JIS K7126, was substantially non-porous and had a thickness of 50 μm.

EXAMPLE 29

In the same manner as in Example 27, a tracing paper having a basis weight of 8 g/m$^2$ was coated with 5 g/m$^2$ in total of a 50 wt % diammonium phosphate solution and a 50 wt % lithium chloride solution as moisture absorbing agents, followed by drying to obtain a tracing paper type total heat exchanging element paper 21. This tracing paper type total heat exchanging element paper had a carbon dioxide permeation constant of not more than $5.0\times10^{-13}$ mol·m/m$^2$·s·Pa measured in accordance with method A (differential pressure method) of JIS K7126, was substantially non-porous and had a thickness of 8 μm.

EXAMPLE 30

A typewriter paper having a basis weight of 16 g/m$^2$ was coated with 12 g/m$^2$ of a 50 wt % diammonium phosphate solution as a moisture absorbing agent, followed by drying to obtain a total heat exchanging element paper 22. This tracing paper type total heat exchanging element paper had a carbon dioxide permeation constant of more than $5.0\times10^{-11}$ mol·m/m$^2$·s·Pa measured in accordance with method A (differential pressure method) of JIS K7126, was substantially porous and had a thickness of 20 μm.

EXAMPLE 31

In the same manner as in Example 30, a typewriter paper having a basis weight of 40 g/m$^2$ was coated with 33 g/m$^2$ of a 50 wt % diammonium phosphate solution as a moisture absorbing agent, followed by drying to obtain a total heat exchanging element paper 23. This tracing paper type total heat exchanging element paper had a carbon dioxide permeation constant of more than $5.0\times10^{-11}$ mol·m/m$^2$·s·Pa measured in accordance with method A (differential pressure method) of JIS K7126, was substantially porous and had a thickness of 50 μm.

EXAMPLE 32

In the same manner as in Example 30, an ultra-thin typewriter paper having a basis weight of 8 g/m$^2$ was coated with 5 g/m$^2$ in total of a 50 wt % diammonium phosphate solution and a 50 wt % lithium chloride solution as moisture absorbing agents, followed by drying to obtain a total heat exchanging element paper 24. This tracing paper type total heat exchanging element paper had a carbon dioxide permeation constant of more than $5.0\times10^{-11}$ mol·m/m$^2$·s·Pa measured in accordance with method A (differential pressure method) of JIS K7126, was substantially porous and had a thickness of 10 μm.

EXAMPLE 33

A tracing paper having a basis weight of 75 g/m$^2$ was coated with 55 g/m$^2$ of a 50 wt % diammonium phosphate solution as a moisture absorbing agent, followed by drying to obtain a tracing paper type total heat exchanging element paper 25. This tracing paper type total heat exchanging element paper had a carbon dioxide permeation constant of not more than $5.0\times10^{-13}$ mol·m/m$^2$·s·Pa measured in accordance with method A (differential pressure method) of JIS K7126, was substantially non-porous and had a thickness of 75 μm.

EXAMPLE 34

A tracing paper having a basis weight of 5 g/m$^2$ was coated with 2.8 g/m$^2$ of a 50 wt % diammonium phosphate solution and a lithium chloride solution as moisture absorbing agents, followed by drying to obtain a tracing paper type total heat exchanging element paper 26. This tracing paper type total heat exchanging element paper had a carbon dioxide permeation constant of more than $5.0\times10^{-11}$ mol·m/m$^2$·s·Pa measured in accordance with method A (differential pressure method) of JIS K7126, was substantially porous and had a thickness of 5 μm.

The total heat exchanging element papers produced in the above Examples were evaluated by the following evaluation methods. The results are shown in Table 4.

(Water Vapor Permeability)

Evaluation was conducted in the same manner as in Examples 1-7.

(Quantity of Heat Transfer)

Evaluation was conducted in the same manner as in Examples 1-7.

(Gas Barrier Property: Leakage Amount of Carbon Dioxide)

Evaluation was conducted in the same manner as in Examples 8-13 and 15-18.

TABLE 4

| | Tracing paper or other paper | Thickness μm | Water vapor permeability g/m$^2$ · 24 h | Quantity of heat transfer W/° C. | Leakage amount of carbon dioxide |
|---|---|---|---|---|---|
| Example 27 | Tracing paper | 20 | 7950 | 29000 | ◎ |
| Example 28 | Tracing paper | 50 | 6600 | 13500 | ◎ |

TABLE 4-continued

| | Tracing paper or other paper | Thickness μm | Water vapor permeability g/m$^2$ · 24 h | Quantity of heat transfer W/° C. | Leakage amount of carbon dioxide |
|---|---|---|---|---|---|
| Example 29 | Tracing paper | 3 | 16500 | 43000 | ◎ |
| Example 30 | Typewriter paper | 20 | 6500 | 23000 | X |
| Example 31 | Typewriter paper | 50 | 5300 | 11000 | X |
| Example 32 | Typewriter paper | 10 | 10800 | 39500 | X |
| Example 33 | Tracing paper | 75 | 2100 | 6200 | ◎ |
| Example 34 | Tracing paper | 5 | 17000 | 45000 | X |

(Evaluation)

It is clear from the results of Examples 27-29 and 30-34 that the total heat exchanging elements using the tracing paper type non-porous total heat exchanging element papers of the present invention are excellent in heat transferability, water vapor permeability and gas barrier property. It is clear that in the case of using porous type papers without using the tracing papers, when the thickness is increased or a binder is mixed to fill the pores, the leakage amount of carbon dioxide can be reduced, but simultaneously the water vapor permeability and the quantity of heat transfer decrease, and thus satisfactory total heat exchanging element papers cannot be obtained, and, besides, the leakage amount of carbon dioxide in the case of using the porous type papers is extremely greater than that in the case of using the non-porous total heat exchanging element papers of the present invention, and the gas barrier property of the porous type papers is considerably inferior to the papers of the present invention. Since the tracing paper type total heat exchanging element papers of the present invention are basically non-porous, even when the thickness is reduced, they have sufficient carbon dioxide barrier property, and by reducing the thickness, both water vapor permeability and quantity of heat transfer (heat exchangeability) are improved, resulting in the better total heat exchanging element papers. The total heat exchanging elements using the total heat exchanging element papers of the present invention satisfactorily perform exchanging of heat and water without causing mixing of air supplied from outside of a room and air discharged from inside of a room, and thus can provide high total heat exchanging function. Furthermore, the papers having a thickness within the range of the present invention can give good heat transferability, water vapor permeability and gas barrier property. If the thickness is more than that of the present invention, the gas barrier property is sufficient, but the heat transferability and the water vapor permeability are not sufficient, and thus the papers are not preferred as total heat exchanging element papers. If the thickness is less than that of the present invention, the gas barrier property is not sufficient probably because of formation of pin holes, and thus the papers are also not preferred as total heat exchanging element papers.

EXAMPLE 35

A glassine paper having a basis weight of 20 g/m$^2$ was coated with 9 g/m$^2$ of a 50 wt % diammonium phosphate solution as a moisture absorbing agent, followed by drying to obtain a glassine paper type total heat exchanging element paper 27. This glassine paper type total heat exchanging element paper had a carbon dioxide permeation constant of not more than $5.0\times10^{-13}$ mol·m/m$^2$·s·Pa measured in accordance with method A (differential pressure method) of JIS K7126, was substantially non-porous and had a thickness of 25 μm.

EXAMPLE 36

In the same manner as in Example 35, a glassine paper having a basis weight of 40 g/m$^2$ was coated with 28 g/m$^2$ of a diammonium phosphate solution as a moisture absorbing agent, followed by drying to obtain a glassine paper type total heat exchanging element paper 28. This glassine paper type total heat exchanging element paper had a carbon dioxide permeation constant of not more than $5.0\times10^{-13}$ mol·m/m$^2$·s·Pa measured in accordance with method A (differential pressure method) of JIS K7126, was substantially non-porous and had a thickness of 50 μm.

EXAMPLE 37

In the same manner as in Example 35, a glassine paper having a basis weight of 8 g/m$^2$ was coated with 4 g/m$^2$ in total of a 50 wt % diammonium phosphate solution and a 50 wt % lithium chloride solution as moisture absorbing agents, followed by drying to obtain a glassine paper type total heat exchanging element paper 29. This glassine paper type total heat exchanging element paper had a carbon dioxide permeation constant of not more than $5.0\times10^{-13}$ mol·m/m$^2$·s·Pa measured in accordance with method A (differential pressure method) of JIS K7126, was substantially non-porous and had a thickness of 10 μm.

EXAMPLE 38

A typewriter paper having a basis weight of 16 g/m$^2$ was coated with 10 g/m$^2$ of a 50 wt % diammonium phosphate solution as a moisture absorbing agent, followed by drying to obtain a total heat exchanging element paper 30. This glassine paper type total heat exchanging element paper had a carbon dioxide permeation constant of more than $5.0\times10^{-11}$ mol·m/m$^2$·s·Pa measured in accordance with method A (differential pressure method) of JIS K7126, was substantially porous and had a thickness of 20 μm.

EXAMPLE 39

In the same manner as in Example 38, a typewriter paper having a basis weight of 40 g/m$^2$ was coated with 27 g/m$^2$ of a 50 wt % diammonium phosphate solution as a moisture absorbing agent, followed by drying to obtain a total heat exchanging element paper 31. This glassine paper type total heat exchanging element paper had a carbon dioxide permeation constant of more than $5.0\times10^{-11}$ mol·m/m$^2$·s·Pa measured in accordance with method A (differential pressure method) of JIS K7126, was substantially porous and had a thickness of 50 μm.

EXAMPLE 40

In the same manner as in Example 38, an ultra-thin typewriter paper having a basis weight of 8 g/m$^2$ was coated with 4 g/m$^2$ in total of a 50 wt % diammonium phosphate solution and a 50 wt % lithium chloride solution as moisture absorbing agents, followed by drying to obtain a total heat exchanging element paper 32. This glassine paper type total heat exchanging element paper had a carbon dioxide permeation constant of more than $5.0\times10^{-11}$ mol·m/m$^2$·s·Pa measured in accordance with method A (differential pressure method) of JIS K7126, was substantially porous and had a thickness of 10 μm.

EXAMPLE 41

A glassine paper having a basis weight of 75 g/m$^2$ was coated with 45 g/m$^2$ of a 50 wt % diammonium phosphate solution as a moisture absorbing agent, followed by drying to obtain a glassine paper type total heat exchanging element paper 33. This glassine paper type total heat exchanging element paper had a carbon dioxide permeation constant of not more than $5.0\times10^{-13}$ mol·m/m$^2$·s·Pa measured in accordance with method A (differential pressure method) of JIS K7126, was substantially non-porous and had a thickness of 85 μm.

EXAMPLE 42

A glassine paper having a basis weight of 8 g/m$^2$ was coated with 2.2 g/m$^2$ of a 50 wt % diammonium phosphate solution and a lithium chloride solution as moisture absorbing agents, followed by drying to obtain a glassine paper type total heat exchanging element paper 34. This glassine paper type total heat exchanging element paper had a carbon dioxide permeation constant of more than $5.0\times10^{-11}$ mol·m/m$^2$·s·Pa measured in accordance with method A (differential pressure method) of JIS K7126, was substantially porous and had a thickness of 8 μm.

The total heat exchanging element papers produced in the above Examples were evaluated by the following evaluation methods. The results are shown in Table 5.

(Water Vapor Permeability)

Evaluation was conducted in the same manner as in Examples 1-7.

(Quantity of Heat Transfer)

Evaluation was conducted in the same manner as in Examples 1-7.

(Barrier Property: Leakage Amount of Carbon Dioxide)

Evaluation was conducted in the same manner as in Examples 8-13 and 15-18.

TABLE 5

| | Glassine paper or other paper | Thickness μm | Water vapor permeability g/m$^2$ · 24 h | Quantity of heat transfer W/° C. | Leakage amount of carbon dioxide |
|---|---|---|---|---|---|
| Example 35 | Glassine paper | 20 | 7000 | 23000 | ◎ |
| Example 36 | Glassine paper | 50 | 5800 | 11500 | ◎ |
| Example 37 | Glassine paper | 10 | 14000 | 35000 | ◎ |
| Example 38 | Typewriter paper | 20 | 6500 | 23000 | X |
| Example 39 | Typewriter paper | 50 | 5300 | 11000 | X |
| Example 40 | Typewriter paper | 10 | 10800 | 39500 | X |
| Example 41 | Glassine paper | 75 | 2100 | 6200 | ◎ |
| Example 42 | Glassine paper | 5 | 17000 | 45000 | X |

(Evaluation)

It is clear from the results of Examples 35-37 and 38-42 that the total heat exchanging elements using the glassine paper type non-porous total heat exchanging element papers of the present invention are excellent in heat transferability, water vapor permeability and gas barrier property. It is clear that in the case of using porous type papers without using the glassine papers, when the thickness is increased or a binder is mixed to fill the pores, the leakage amount of carbon dioxide can be reduced, but simultaneously the water vapor permeability and the quantity of heat transfer decrease, and thus satisfactory total heat exchanging element papers cannot be obtained, and, besides, the leakage of carbon dioxide is extremely greater than that in the case of using the non-porous total heat exchanging element papers of the present invention and the gas barrier property of the porous type papers is considerably inferior to the papers of the present invention. Since the glassine paper type total heat exchanging element papers of the present invention are basically non-porous, even when the thickness is made thin, they have sufficient carbon dioxide barrier property, and by reducing the thickness, both water vapor permeability and quantity of heat transfer (heat exchangeability) are improved, resulting in the better total heat exchanging element papers. The total heat exchanging elements using the total heat exchanging element papers of the present invention can satisfactorily perform exchanging of heat and water without causing mixing of air supplied from outside of a room and air discharged from inside of a room, and thus can provide high total heat exchanging function. Furthermore, the papers having a thickness within the range of the present invention can give good heat transferability, water vapor permeability and gas barrier property. If the thickness is more than that of the present invention, the gas barrier property is sufficient, but the heat transferability and the water vapor permeability are not sufficient, and thus the papers are not preferred as total heat exchanging element papers. If the thickness is less than that of the present invention, the gas barrier property is not sufficient probably because of formation of pin holes, and thus the papers are also not preferred as total heat exchanging element papers.

INDUSTRIAL APPLICABILITY

According to the present invention, there can be provided excellent total heat exchanging element papers and total heat exchanging elements which are excellent in heat transferability, water vapor permeability and gas barrier properties and cause no mixing of supplied air and discharged air.

The invention claimed is:

1. A total heat exchanging element paper which comprises a paper containing, as a fiber component, only a natural pulp beaten to a Canadian modification freeness of not more than 150 ml, wherein the Canadian modification freeness is the value obtained by carrying out a measurement in accordance with Canadian standard freeness testing method of JIS P8121, except that 0.5 g of a pulp in absolute dry weight is used and a plain weave bronze wire of 80 mesh is used as a sieve;

wherein the total heat exchanging element paper is treated by coating or impregnating with a moisture absorbing agent selected from the group consisting of lithium chloride and diammonium phosphate; and wherein the total heat exchanging element paper has a density of not less than 0.9 $g/cm^3$; and wherein the total heat exchanging element paper has a carbon dioxide permeability measured in accordance with JIS K7126, method A (differential pressure method) of not more than $3.4\times10^{-9}$ $mol/m^2\cdot s\cdot Pa$, wherein the total heat exchanging element paper has a water vapor permeability at 40° C., 90% of 6100 $g/m^2\cdot 24$ h or more, measured in accordance with JIS Z 0208, except that the water vapor permeability was obtained by measuring the weight every 1 hour.

2. A total heat exchanging element, which is a partition plate comprising a corrugated paper, said corrugated paper comprising the total heat exchanging element paper of claim 1.

3. A heat exchange method, comprising the step of:

passing air discharged from a room along one side of the total heat exchanging element paper of claim 1, and passing supplied air along the other side of the total heat exchanging element paper.

4. The total heat exchanging element paper according to claim 1 wherein the total heat exchanging element paper has been subjected to a calendering treatment so as to have a density of not less than 0.9 $g/cm^3$.

* * * * *